US010202934B2

(12) United States Patent
Murphy

(10) Patent No.: US 10,202,934 B2
(45) Date of Patent: Feb. 12, 2019

(54) CYLINDER HEAD

(71) Applicant: Ford Global Technologies, LLC, Dearborn, MI (US)

(72) Inventor: Patrick Murphy, Loughton (GB)

(73) Assignee: Ford Global Technologies, LLC, Dearborn, MI (US)

( * ) Notice: Subject to any disclaimer, the term of this patent is extended or adjusted under 35 U.S.C. 154(b) by 237 days.

(21) Appl. No.: 15/173,318

(22) Filed: Jun. 3, 2016

(65) Prior Publication Data

US 2016/0369739 A1 Dec. 22, 2016

(30) Foreign Application Priority Data

Jun. 19, 2015 (GB) ..... 1510778.2

(51) Int. Cl.
*F01N 13/10* (2010.01)
*F02F 1/42* (2006.01)
*F01N 13/18* (2010.01)

(52) U.S. Cl.
CPC ..... *F02F 1/4264* (2013.01); *F01N 13/10* (2013.01); *F01N 13/1805* (2013.01); *F01N 2260/20* (2013.01); *F02F 1/42* (2013.01)

(58) Field of Classification Search
CPC .... F02F 1/4264; F01N 13/10; F01N 13/1805; F01N 2260/20
See application file for complete search history.

(56) References Cited

U.S. PATENT DOCUMENTS

| | | | | |
|---|---|---|---|---|
| 7,241,426 | B2 * | 7/2007 | Hardesty | B01D 53/9454 422/177 |
| 9,347,361 | B2 * | 5/2016 | Murakami | F01N 13/10 |
| 2013/0061586 | A1 | 3/2013 | Demots et al. | |

FOREIGN PATENT DOCUMENTS

| | | | |
|---|---|---|---|
| DE | 202005001755 | U1 | 6/2006 |
| DE | 102005047575 | A1 | 8/2006 |
| FR | 2886338 | A1 | 12/2006 |
| JP | H0821236 | A | 1/1996 |
| JP | 2000154721 | A | 6/2000 |
| WO | 2014060834 | A2 | 4/2014 |

OTHER PUBLICATIONS

Examination Report of Great Britain Patent Application No. 1510778.2, dated Oct. 30, 2015, 6 pages, United Kingdom Intellectual Property Office.

* cited by examiner

*Primary Examiner* — Kevin A Lathers

(74) *Attorney, Agent, or Firm* — Julia Voutyras; McCoy Russell LLP

(57) ABSTRACT

A cylinder head for an internal combustion comprises a plurality of exhaust outlets distributed along a longitudinal axis of the cylinder head, wherein the exhaust outlets are configured to align with corresponding exhaust gas transfer tubes of the exhaust manifold and each exhaust outlet comprises a mating surface configured to receive flanges on the exhaust gas transfer tubes. The cylinder head further includes two or more abutment shoulders, each abutment shoulder associated with a different exhaust outlet and extending beyond the mating surfaces, the abutment shoulders being integral with the remainder of the cylinder head. The abutment shoulders each include an abutment surface configured to interface with the exhaust gas transfer tubes so as to restrict contraction of the exhaust manifold along a length of the exhaust manifold extending in the direction of the longitudinal axis of the cylinder head.

18 Claims, 4 Drawing Sheets

CYLINDER HEAD

CROSS REFERENCE TO RELATED APPLICATION

This application claims priority to Great Britain Patent Application No. 1510778.2, filed Jun. 19, 2015, the entire contents of each of which are hereby incorporated by reference for all purposes.

FIELD

The disclosure relates to a cylinder head of an internal combustion engine.

BACKGROUND/SUMMARY

Exhaust manifolds experience thermal cycling as they undergo repeated heating and cooling. Exhaust manifolds operate in a high temperature environment (e.g., in an environment with temperatures around or greater than 1000° C.), which may approach the operating limits of the material from which it is constructed. Such materials include austenitic and ferritic cast iron and austenitic and ferritic cast stainless steel. Specifically, exhaust manifolds may be cast out of these materials. Over the life of an engine an exhaust manifold may heat up and cool down many times, which may cause distortion. During a hot phase, an exhaust manifold may expand up to 3 mm in length, for example. When the exhaust manifold cools down, however, the manifold may contract (e.g., permanently contract). This results in the exhaust manifold contracting to a shorter length than initially desired, such that after many thermal cycles the exhaust manifold is 3 mm shorter in length compared to its original length, for example. During the contraction phase, hotter sections of the manifold may have lower strength and consequentially can experience permanent plastic deformation. This distortion may cause excessive internal stress and ultimately breakage of the exhaust manifold resulting in exhaust gas leakage.

The inventors herein recognize the above described problems and to address these problems, at least partially, propose a cylinder head of an engine, including a plurality of exhaust outlets distributed along a longitudinal axis of the cylinder head, each exhaust outlet of the plurality of exhaust outlets configured to align with a corresponding exhaust gas transfer tube of an exhaust manifold, each exhaust outlet of the plurality of exhaust outlets including a mating surface configured to receive flanges on the corresponding exhaust gas transfer tube, and at least two abutment shoulders, each of the at least two abutment shoulders associated with a different exhaust outlet of the plurality of exhaust outlets and extending beyond a respective mating surface, the at least two abutment shoulders integral with a remainder of the cylinder head, each of the at least two abutment shoulders having an abutment surface configured to interface with the corresponding exhaust gas transfer tube to restrict a lengthwise contraction of the exhaust manifold.

In one example, a cylinder head of an engine may include a mating surface for receiving an exhaust manifold, a first abutment shoulder extending beyond the mating surface and including a first abutment surface, and a second abutment shoulder extending beyond the mating surface and including a second abutment surface, the first abutment shoulder and the second abutment shoulder integral with the remainder of the cylinder head, each of the first abutment surface and second abutment surface configured to interface with a respective adjoining wall of the exhaust manifold to restrict contraction of the exhaust manifold.

In summary, excessive contraction of an exhaust manifold that experiences thermal cycling may be restricted by providing one or more abutment shoulders on a cylinder head surface mating with the exhaust manifold. Restricting excessive contraction of the exhaust manifold by one or more abutment shoulders on the cylinder head may reduce development of excessive internal stress in the exhaust manifold, thereby increasing the life of the exhaust manifold by preventing the development of cracks.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
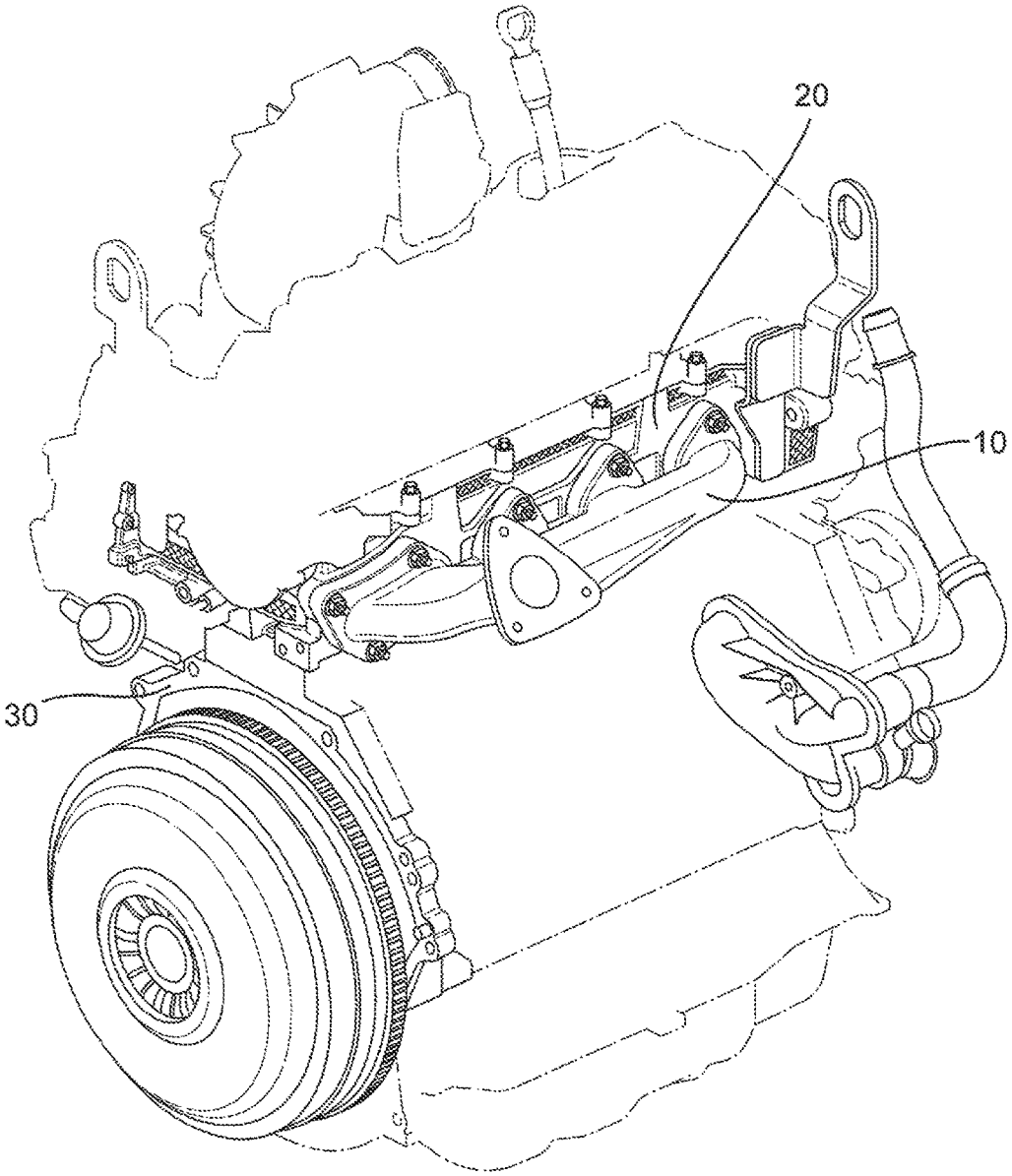
FIG. 1 Prior art
FIG. 1 shows a perspective view of a previously-proposed engine with a cylinder head and exhaust manifold.

According to an aspect of the present disclosure, there is provided a cylinder head for an internal combustion engine, the cylinder head comprising a plurality of exhaust outlets distributed along a longitudinal axis of the cylinder head, wherein the exhaust outlets are configured to align with corresponding exhaust gas transfer tubes of the exhaust manifold and each exhaust outlet comprises a mating surface configured to receive flanges on the exhaust gas transfer tubes, wherein the cylinder head further comprises two or more abutment shoulders each associated with a different exhaust outlet and extending beyond the mating surfaces, the abutment shoulders being integral, e.g., unitary, with the remainder of the cylinder head, wherein the abutment shoulders each comprise an abutment surface configured to interface with the exhaust gas transfer tubes so as to restrict a lengthwise contraction of the exhaust manifold, e.g., along a length of the exhaust manifold extending in the direction of the longitudinal axis of the cylinder head.

In one example, the abutment shoulders may be provided at an edge of the mating surface, along a recess of the mating surface, where the edge of the mating surface leads to the beginning of the recess. The abutment shoulders may be provided on a side of the mating surface that faces away from (e.g., is furthest from) ends of the cylinder head.

In another example, the abutment shoulders may be provided between neighbouring exhaust outlets. The exhaust outlets may be aligned with one another. The abutments shoulders may be provided in line with the exhaust outlets.

A first abutment shoulder may be associated with (e.g., provided alongside) an exhaust outlet at a first end of the cylinder head. A second abutment shoulder may be associated with (e.g., provided alongside) an exhaust outlet at a second end of the cylinder head. For example, the first abutment shoulder may be provided adjacent to a first exhaust outlet and the second abutment shoulder may be provide adjacent to a last (e.g., fourth) exhaust outlet on the cylinder head. The abutments shoulders may be provided on the side of the associated exhaust outlet that faces (e.g., is closest to) the centre of the cylinder head.

Each exhaust outlet may have one or fewer abutment shoulders associated therewith. In other words, the exhaust outlets may have only one (or no) abutment shoulder(s). The abutment shoulders may be provided on one side of the respective exhaust outlet only.

The abutment shoulders may be spaced such that there may be a first gap between the abutment surfaces and the corresponding exhaust gas transfer tubes when the exhaust manifold and cylinder head are first assembled, e.g., before the exhaust manifold has expanded or contracted due to the thermal cycling encountered during use.

The abutment shoulders may comprise a further surface opposite the abutment surface. The further surface may be arranged to face a neighbouring exhaust gas transfer tube. The abutment shoulders may be sized such that there may be a second gap between the further surface of the abutment shoulder and the neighbouring exhaust gas transfer tube when the exhaust manifold and cylinder head are first assembled, and during expansion of the exhaust manifold, such that the abutment shoulders may permit expansion of the exhaust manifold. The second gap may be larger than the first gap when the exhaust manifold and cylinder head are first assembled. The abutment shoulders may thus restrict contraction of the exhaust manifold, but not restrict expansion of the exhaust manifold.

The further surface of the abutment shoulder may be ramped, e.g. non-perpendicular to the mating surface. The further surface may be ramped such that the abutment shoulder may be narrower at an end furthest from the mating surface. The abutment surface may be perpendicular to mating surface.

The engine assembly may further comprise a heat shield configured to connect to at least one of the abutment shoulders. The heat shield may be a heat shield for the exhaust manifold. The heat shield may be present along a top surface of the exhaust manifold, and may be configured to be in contact with the abutment shoulders along the exhaust outlets of the exhaust manifold. At least one of the abutment shoulders may be configured to support the heat shield.

According to a second aspect of the present disclosure there is provided an engine assembly comprising the cylinder head and the exhaust manifold according to any of the above statements.

Figure 2:
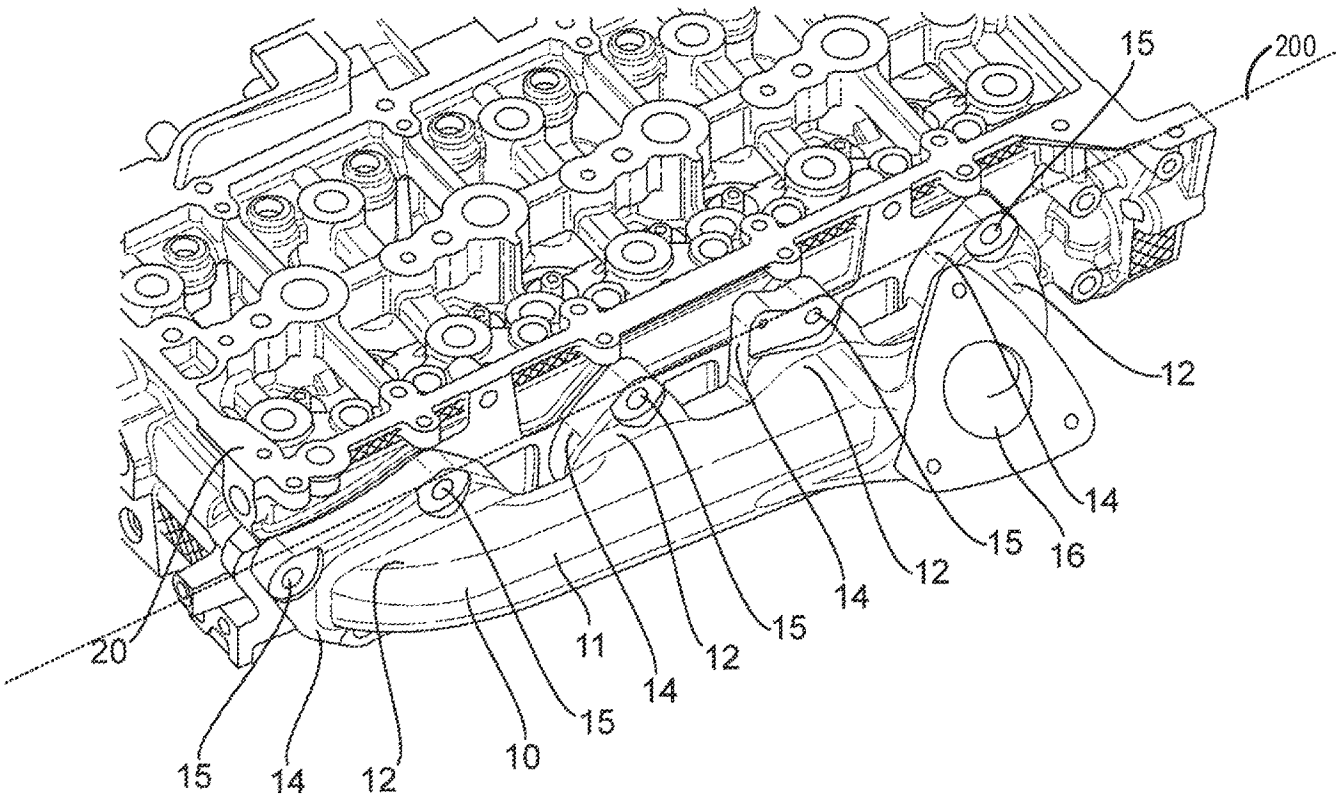
FIG. 2 Prior art
FIG. 2 is a perspective view of a previously-proposed cylinder head and exhaust manifold.
Figure 3:
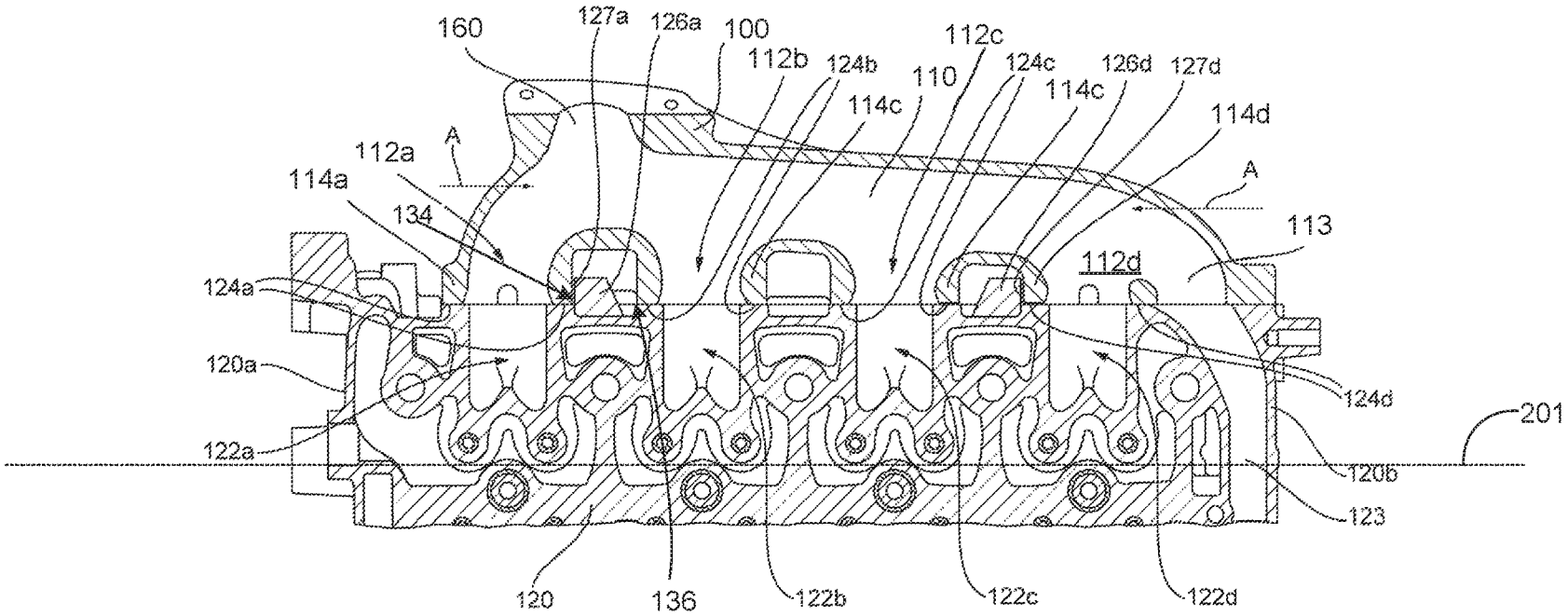
FIG. 3 is a sectional view of a cylinder head and an exhaust manifold according to an arrangement of the present disclosure.
Figure 4:
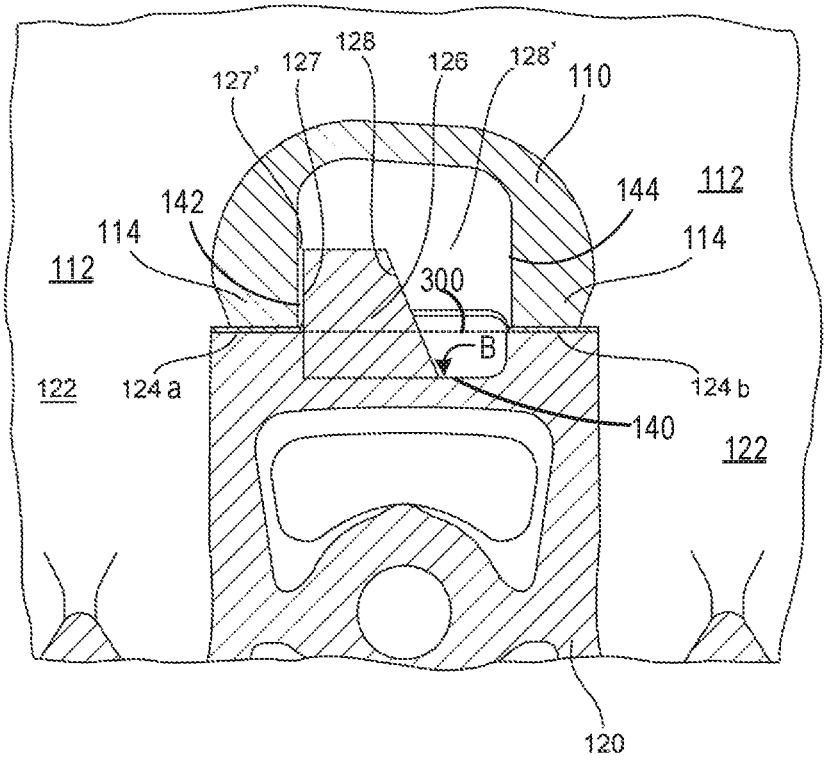
FIG. 4 is an enlarged sectional view of the cylinder head and the exhaust manifold according to the arrangement of the present disclosure.

FIGS. 1 and 2 show a previously proposed exhaust manifold, which may expand and contract due to thermal cycling. This distortion may cause excessive internal stress and ultimately breakage of the exhaust manifold resulting in exhaust gas leakage. FIGS. 3 and 4 show a cylinder head for an internal combustion engine, the cylinder head comprising a plurality of exhaust outlets distributed along a longitudinal axis of the cylinder head, wherein the exhaust outlets are configured to align with corresponding exhaust gas transfer tubes of the exhaust manifold and each exhaust outlet comprises a mating surface configured to receive flanges on the exhaust gas transfer tubes, wherein the cylinder head further comprises two or more abutment shoulders each associated with a different exhaust outlet and extending beyond the mating surfaces, the abutment shoulders being integral, e.g. unitary, with the remainder of the cylinder head, wherein the abutment shoulders each comprise an abutment surface configured to interface with the exhaust gas transfer tubes so as to restrict a lengthwise contraction of the exhaust manifold, e.g., along a length of the exhaust manifold extending in the direction of the longitudinal axis of the cylinder head.

FIGS. 1-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIGS. 1 and 2 show a previously-proposed exhaust manifold 10. The exhaust manifold 10 of an engine 30 (shown in FIG. 1) may include a plurality of exhaust gas transfer tubes 12 and a plurality of flanges 14 to connect the exhaust manifold 10 along a longitudinal axis 200 to a cylinder head 20 of the engine 30, as illustrated in FIG. 2. The exhaust manifold 10 comprises a body defining at least two exhaust gas transfer tubes 12, which may join or blend into a common tube 11 comprising a common exhaust gas outlet 16.

The exhaust manifold 10 experiences thermal cycling as it is repeatedly heated and cooled. This causes the exhaust manifold 10 to expand and contract. During the contraction phase, hotter sections of the exhaust manifold 10 have lower strength and consequentially can experience permanent plastic deformation. This results in the exhaust manifold 10 contracting to a shorter length than initially accounted for. This distortion may cause excessive internal stress and ultimately breakage of the exhaust manifold resulting in exhaust gas leakage. As will be apparent from FIG. 2, the flanges 14 may extend (e.g., protrude) further in a direction perpendicular to the longitudinal axis 200 of the cylinder head than in a direction parallel to the longitudinal axis 200. Fasteners (not shown) may pass through openings 15 in the flanges 14 to connect the exhaust manifold 10 to the cylinder head 20.

With reference to FIG. 3, the present disclosure relates to a cylinder head 120 for an internal combustion engine, which can be used in combination with and as a component of engine 30 illustrated in FIG. 1 and/or manifold illustrated in FIG. 2. The cylinder head 120 may be separate from the rest of an engine block or integral with other engine block portions. The cylinder head 120 comprises a plurality of exhaust outlets 122*a*-122*d*, which, when the engine is assembled, are in fluidic communication with respective cylinders of the engine (not shown), by virtue of one or more exhaust valves (not shown). The plurality of exhaust outlets 122*a*-122*d* may be aligned and distributed along a longitudinal axis 201 of the cylinder head 120. Exhaust gases from the cylinders pass through the plurality of exhaust outlets 122*a*-122*d* to an exhaust manifold 100, similar to the exhaust manifold 10 illustrated in FIGS. 1 and 2.

The exhaust manifold 100 comprises a body defining at least two or more exhaust gas transfer tubes 112, which join or blend into the common tube 110 comprising a common exhaust gas outlet 160, similar to the exhaust gas outlet 16 of FIG. 2. The common tube 110 may extend substantially in a longitudinal direction along the longitudinal axis 201 of the cylinder head 120.

In the particular arrangement depicted in FIG. 3, the exhaust manifold 100 comprises four exhaust gas transfer tubes 112*a*, 112*b*, 112*c*, 112*d*, which align with and are in fluidic communication with the plurality of exhaust outlets 122*a*, 122*b*, 122*c*, 122*d*, respectively. However, it will be appreciated that other numbers of exhaust outlets and exhaust gas transfer tubes are contemplated and that the number of exhaust gas transfer tubes does not have to be the same as the number of exhaust outlets, e.g. due to siamesed exhaust outlets.

The exhaust manifold 100 may comprise a further transfer tube 113, which is not associated with a cylinder of the engine. The further transfer tube 113 may be in fluidic communication with an exhaust gas recirculation passage 123 or any other passage, which may pass through the cylinder head 120.

The exhaust manifold 100 may correspond to the previously-proposed exhaust manifold 10 depicted in FIGS. 1 and 2. Accordingly, the exhaust manifold 100 may include flanges 114*a*-114*d* along with each of the exhaust gas transfer tubes 112*a*-112*d* having a respective flange 114*a*-114*d* for securing the exhaust manifold in use to the engine, similar to the exhaust transfer tubes 12 and the flanges 14 illustrated in FIGS. 1 and 2. As depicted, the flanges 114*a*-114*d* for each exhaust gas transfer tube 112*a*-112*d* may be separate from one another and may not be continuous single flange for all four exhaust gas transfer tubes. However, a common flange may be provided for two exhaust gas transfer tubes, such as for a middle pair of exhaust gas transfer tubes 112*b*, 112*c*. Furthermore, in the arrangement shown, a common flange 114*d* may also be provided across a fourth exhaust gas transfer tube 112*d* and the further transfer tube 113.

In FIG. 3, each exhaust outlet of the plurality of exhaust outlets 122*a*-122*d* includes mating surfaces 124*a*-124*d* configured to receive the flanges 114*a*-114*d*. Accordingly, the mating surfaces 124*a*-124*d* may surround the exhaust outlets 122*a*-122*d*. To facilitate engagement, the mating surfaces 124*a*-124*d* and corresponding mating surfaces of the flanges 114*a*-114*d* may be substantially flat. As depicted, the mating surfaces 124*a*-124*d* may be separate from one another. In other example, one or more of the mating surfaces may be joined together. In another example, each of the mating surfaces 124*a*-124*d* may collectively form a single mating surface of the cylinder head 120.

Referring still to FIG. 3, the cylinder head 120 further comprises at least two abutment shoulders 126. Each abutment shoulder of the at least two abutment shoulders 126 may be associated with a different exhaust outlet of the plurality of exhaust outlets 122*a*-122*d*, although a particular exhaust outlet may not have an abutment shoulder associated therewith. In other words, a particular exhaust outlet of the plurality of exhaust outlets 122*a*-122*d* may have only one abutment shoulder, while another exhaust outlet may not have any abutment shoulder. In the particular arrangement shown in FIG. 3, a first abutment shoulder 126*a* of the at least two abutment shoulders 126 may be associated with a first exhaust outlet 122*a* of the plurality of exhaust outlets 122*a*-122*b* at a first end 120*a* of the cylinder head. A second abutment shoulder 126*d* of the at least two abutment shoulders 126 may be associated with a fourth exhaust outlet 122*d* of the plurality of exhaust outlets 122*a*-122*b* at a second end 120*b* of the cylinder head 120. By contrast, second and third exhaust outlets 122*b*, 122*c* may not have an abutment shoulder associated therewith.

The at least two abutment shoulders 126 may be provided adjacent to (e.g., alongside) each of the associated exhaust outlet of the plurality of exhaust outlets 122*a*-122*d*. In one example, the first abutment shoulder 126*a* may be positioned along an edge 134 of the mating surface 124*a*. The abutment shoulder 126*a* may extend (e.g., protrude) beyond the mating surface 124 in a direction that may be substantially perpendicular (e.g., equal to 90 degrees or 5-10 degrees more or less than 90 degrees) relative to the mating surface 124*a*. As used herein, substantially includes equal to a given value, or within a threshold range of the given value, such as within 10% of the given value. In one example, substantially perpendicular may include all angles within 5 or 10 degrees of 90 degrees relative to the longitudinal axis 201. The abutment shoulders 126*a* may also extend in a direction parallel to mating surface 124*a*, towards an edge 136 of the mating surface 124*b*.

The plurality of exhaust outlets 122*a*-122*d* may be aligned with one another, e.g. along the longitudinal axis 201 of the cylinder head 120. Relative to the plurality of exhaust outlets 122*a*-122*d*, the first abutment shoulder 126*a* may be present between the first exhaust outlet 122*a* and the second exhaust outlet 122*b*, and may be adjacent to the mating surface 124*a* and 124*b*, projecting or protruding away from the cylinder head 120. The first abutment shoulder 126*a* may protrude in a direction away from the cylinder head 120 and the protrusion may be perpendicular (e.g., 90 degrees) or substantially perpendicular. As used herein, substantially includes equal to a given value, or within a threshold range of the given value, such as within 10% of the given value. In one example, substantially perpendicular may include all angles within 5 or 10 degrees of 90 degrees relative to the longitudinal axis 201.

Similarly, the second abutment shoulder 126*d* may be present between the exhaust outlet 122*c* and 122*d*, and may be adjacent to the mating surfaces 124*c* and 124*d*, projecting or protruding away from the cylinder head 120. Similar to the first abutment shoulder, the second abutment shoulder 126*b* may protrude in a direction away from the cylinder head 120 and the protrusion may be perpendicular or substantially perpendicular, for example, the direction protrusion of the second abutment shoulder 126 may be at an angle of 90 degrees or close to 90 degrees (e.g., 5-10 degrees less than or more than 90 degrees), relative to the longitudinal axis 201.

The at least two abutment shoulders 126 may be provided on a side of the respective exhaust outlet 122. The at least two abutments shoulders 126 may be provided on the side of the associated exhaust outlet 122 that is closest to a centre of the cylinder head (or is furthest from the first and second ends 120*a*, 120*b* of the cylinder head). Accordingly, the at least two abutment shoulders 126 may be provided between neighbouring exhaust outlets 122. In particular, the abutment shoulders 126 may extend from a region between neighbouring mating surfaces 124. The region between neighbouring mating surfaces 124 may be recessed relative to the mating surfaces, as will be described below with reference to FIG. 4.

The at least two abutment shoulders 126 may be integral, e.g. unitary, with the remainder of the cylinder head 120. For example, the at least two abutment shoulders 126 may be part of same casting as the cylinder head. Since, the at least two abutment shoulders are integrated to the cylinder head, they may not fail over time, unlike stoppers attached (for example, attached by one or more screws to the cylinder head) to the cylinder head to restrict contraction of an associated exhaust manifold, which may fail (due to loosening of the screw due to wear and tear etc.).

The first abutment shoulder 126*a* may include an abutment surface 127*a*, and the second abutment shoulder 126*b* may include an abutment surface 127*d*. Each of the abutment surface 127*a* and 127*d* faces the associated exhaust outlet of the plurality of exhaust outlets 122*a*-122*d* and thus, the associated exhaust gas transfer tube 112 when assembled. The abutment surfaces 127*a* and 127*d* are each configured to interface with the exhaust gas transfer tubes 112*a* and 112*d*, respectively. In particular, the abutment surfaces 127*a* and 127*d* may each interface with the flanges 114*a* and 114*d*, respectively. The flanges 114*a* and 114*d* may be present at the end of the exhaust gas transfer tubes 112*a* and 112*d* respectively, notwithstanding the fact that the flanges 114 may extend by varying amounts around their perimeter. For example, the flange extension (from an inner surface to an outer surface of the exhaust gas transfer tube) may be substantially the same as or even less than a thickness of a wall forming the exhaust gas transfer tubes 112.

The abutment surfaces 127*a* and 127*d* may follow the shape of the associated exhaust gas transfer tube 112. For example, if the flange 114 is curved in a plane parallel to the mating surface, the abutment surfaces 127*a* and 127*d* may also be curved with the same profile. In this way, contact between the abutment surface 127 and the exhaust gas transfer tube 112 may be spread over a region and the resulting stresses may be reduced.

The abutments surface 127*a* may face the first end 120*a* of the cylinder head 120 and the abutment surface 127*b* may face the second end 120*b* of the cylinder head 120. Thus, the abutment surface 127*a* and the abutment surface 127*d* face in opposite directions. This disposition of the abutment surfaces 127 restricts a lengthwise contraction of the exhaust manifold 100, in the direction indicated by arrows A, by virtue of an interaction between each of the abutment surfaces 127 and the associated exhaust gas transfer tubes 112.

FIG. 4 illustrates a single abutment shoulder of the at least two abutment shoulders 126, for example, the first abutment shoulder 126*a*, positioned along the between the mating surfaces 124*a* and the mating surface 124*b* of the exhaust outlet 122 in apposition with the cylinder head 120. The abutment shoulder 126 may be positioned in a recess 140 between the mating surfaces 124*a* and 124*b*. A longitudinal axis 300 of the recess 140 is indicated by a dashed line.

The abutment shoulder 126 may be spaced such that there may be a first gap 127' between the abutment surfaces 127 and a first facing wall 142 of the corresponding exhaust gas transfer tubes 112 when the exhaust manifold 100 and cylinder head 120 are first assembled, e.g., before the exhaust manifold has expanded or contracted due to the thermal cycling encountered during use of the engine. The first gap 127' may be small, e.g., 1 mm or less. The first gap 127' may facilitate assembly of the exhaust manifold 100 onto the cylinder head 120. Furthermore, the first gap 127' may allow a certain amount of contraction of the exhaust manifold before the abutment surfaces 127 contacts the exhaust gas transfer tubes 112. The contraction of the exhaust manifold 100 may be in a direction from the first facing wall 142 towards the abutment surface 127 along the first gap 127'. During contraction, the abutment surface 127 may block the movement of the first facing wall 142 through the first gap, thereby restricting further contraction of the exhaust manifold 100.

Referring still to FIG. 4, the abutment shoulders 126 may comprise a further surface 128 provided on an opposite side of the abutment shoulder 126 to the abutment surface 127. The further surface 128 may be arranged to face away from the associated exhaust outlet 122 and thus associated exhaust gas transfer tube 112 when assembled. Accordingly, the further surface 128 may face a centre of the cylinder head (or away from ends of the cylinder head) and may face a second facing wall 144 of the neighbouring exhaust gas transfer tube 112.

The further surface 128 of the abutment shoulder 126 may be angled at an angle B relative to the longitudinal axis 300 of the recess 140 between the mating surface 124*a* and mating surface 124*b*. The angle B between the further surface 128 relative to the longitudinal axis 300 may be more than then 90°, for example, 110°, making the further surface 128 ramped. The further surface 128 may be ramped such that the abutment shoulder 126 may be narrower (in a direction perpendicular to the longitudinal axis 300) at an end furthest from the recess 140. The ramped further surface may counteract the high bending stress experienced at a bottom of the abutment shoulder. In contrast, the abutment surface 127 may be substantially perpendicular (e.g., angled at 90°) relative to the longitudinal axis 300. In another example, the further surface 128 may not be ramped.

The abutment shoulders 126 may be sized such that there may be a second gap 128' between the further surface 128 of the abutment shoulder and the neighbouring exhaust gas transfer tube 112 when the exhaust manifold and cylinder head are first assembled. The second gap 128' may also exist after an expansion of the exhaust manifold 100 which may occur during use of the engine. The abutment shoulders 126 may therefore not restrict expansion of the exhaust manifold during use of the engine.

The second gap 128' may be larger than the first gap 127' when the exhaust manifold 100 and cylinder head 112 are first assembled. The abutment shoulders 126 may thus restrict contraction of the exhaust manifold 10, but permit likely expansions of the exhaust manifold.

Preventing excessive contraction of the exhaust manifold has been shown to increase the life of the exhaust manifold.

Furthermore, allowing the exhaust manifold to expand helps to prevent a rapid failure mode of the exhaust manifold.

Although not depicted, it is contemplated that at least one of the abutment shoulders 126 may be configured to support a heat shield for the exhaust manifold 10. In other words, one or more of the abutment shoulders 126 may form a heat shield boss to which the heat shield could be mounted. Such an abutment shoulder may additionally extend in a direction parallel to the mating surface to interface with a heat shield.

In this way, excessive contraction of the exhaust manifolds that experience thermal cycling may be restricted by providing one or more abutment shoulders on the cylinder head that prevent exhaust manifold from contracting more than a specific length.

The technical effect of restricting excessive contraction of the exhaust manifold by providing one or more abutment shoulders on the cylinder head mating with the exhaust manifold includes increasing the life of the exhaust manifold by preventing the development of crack/s in the exhaust manifold.

An example system comprises a cylinder head for an internal combustion engine, including a plurality of exhaust outlets distributed along a longitudinal axis of the cylinder head, each exhaust outlet of the plurality of exhaust outlets configured to align with a corresponding exhaust gas transfer tube of an exhaust manifold, each exhaust outlet of the plurality of exhaust outlets including a mating surface configured to receive flanges on the corresponding exhaust gas transfer tube, and at least two abutment shoulders, each of the at least two abutment shoulders associated with a different exhaust outlet of the plurality of exhaust outlets and extending beyond a respective mating surface, the at least two abutment shoulders integral with a remainder of the cylinder head, each of the at least two abutment shoulders having an abutment surface configured to interface with the corresponding exhaust gas transfer tube to restrict a lengthwise contraction of the exhaust manifold. A first example of the system optionally includes, wherein each of the at least two abutment shoulders are provided at an edge of the respective mating surface. A second example of the system optionally includes the first example and further includes, wherein each edge of each respective mating surface flanks a respective recess of that mating surface. A third example of the system optionally includes one or more of the first and second examples, and further includes wherein the at least two abutment shoulders are each provided between respective neighbouring exhaust outlets of the plurality of exhaust outlets. A fourth example of the system optionally includes one or more of the first through the third examples, and further includes, wherein the at least two abutment shoulders are each provided on a side of the respective mating surface that faces away from a respective end of the cylinder head. A fifth example of the system optionally includes one or more of the first through the fourth examples, and further includes, wherein a first abutment shoulder of the at least two abutment shoulders is associated with a first exhaust outlet of the plurality of exhaust outlets at a first end of the cylinder head and a second abutment shoulder of the at least two abutment shoulders is associated with a second exhaust outlet of the at least two abutment shoulders at a second end of the cylinder head. A sixth example of the system optionally includes one or more of the first through the fifth examples, and further includes wherein each exhaust outlet of the plurality of exhaust outlets has one or fewer abutment shoulder of the at least two abutment shoulders associated therewith. A seventh example of the system optionally includes one or more of the first through the sixth examples, and further includes wherein the at least two abutment shoulders are spaced to form respective first gaps between each abutment surface of each of the at least two abutment shoulders and a corresponding exhaust gas transfer tube when the exhaust manifold and the cylinder head are first assembled. An eighth example of the system optionally includes one or more of the first through the seventh examples, and further includes wherein each of the at least two abutment shoulders include a further surface opposite the respective abutment surface, each further surface arranged to face a corresponding neighbouring exhaust gas transfer tube. A ninth example of the system optionally includes one or more of the first through the eighth examples, and further includes wherein each of the at least two abutment shoulders is spaced to form respective second gaps between the further surface of each of the at least two abutment shoulders and the neighbouring exhaust gas transfer tube when the exhaust manifold and cylinder head are first assembled and during expansion of the exhaust manifold the at least two abutment shoulders permit expansion of the exhaust manifold. A tenth example of the system optionally includes one or more of the first through the ninth examples, and further includes wherein each further surface of each of the at least two abutment shoulders is ramped. An eleventh example of the system optionally includes one or more of the first through the tenth examples, and further includes wherein at least one of the at least two abutment shoulders is configured to support a heat shield of the internal combustion engine.

Another example of a cylinder head comprises a mating surface for receiving an exhaust manifold, a first abutment shoulder extending beyond the mating surface and including a first abutment surface, and a second abutment shoulder extending beyond the mating surface and including a second abutment surface, the first abutment shoulder and the second abutment shoulder integral with the remainder of the cylinder head, each of the first abutment surface and second abutment surface configured to interface with a respective adjoining wall of the exhaust manifold to restrict contraction of the exhaust manifold. A first example of the system optionally includes wherein the first abutment surface and the second abutment surface are each substantially perpendicular relative to the mating surface. A second example of the system optionally includes the first example and further includes, wherein the first abutment shoulder includes a first ramped surface opposite the first abutment surface, and the second abutment shoulder includes a second ramped surface opposite the second abutment surface, such that each of the first abutment shoulder and second abutment shoulder narrow toward a respective end of each abutment shoulder farthest from the mating surface. A third example of the system optionally includes one or more of the first and second examples, and further includes further comprising a first gap between the first abutment surface and a first facing wall of the exhaust manifold and a second gap, larger than the first gap, between the first ramped abutment surface and a second facing wall of the exhaust manifold. A fourth example of the system optionally includes one or more of the first through the third examples, and further comprising a third gap between the second abutment surface and a third facing wall of the exhaust manifold and a fourth gap, larger than the third gap, between the second ramped abutment surface and a fourth facing wall of the exhaust manifold.

An example system of an engine head comprises a plurality of exhaust outlets distributed along a longitudinal axis of the cylinder head, the plurality of exhaust outlets configured to align with corresponding exhaust gas transfer tubes of an exhaust manifold, each exhaust outlet of the plurality of exhaust outlets configured to receive a corresponding flange on a corresponding exhaust gas transfer tube, and at least two abutment shoulders, each of the at least two abutment shoulders associated with a different exhaust outlet of the plurality of exhaust outlets and extending beyond a mating surface of the cylinder head, the at least two abutment shoulders integral with a remainder of the cylinder head, each of the at least two abutment shoulders having a respective abutment surface configured to interface with a corresponding exhaust gas transfer tube to restrict a lengthwise contraction of the exhaust manifold, each abutment surface substantially perpendicular to the mating surface, and each of the at least two abutment shoulders having a respective ramped abutment surface, opposite the respective abutment surface of that abutment shoulder, each ramped abutment surface non-perpendicular to the mating surface. A first example of the system optionally includes, wherein the cylinder head defines four cylinders of the internal combustion engine, each cylinder of the four cylinders coupled to a corresponding exhaust outlet of the plurality of exhaust outlets, the at least two abutment shoulders including only a first abutment shoulder and a second abutment shoulder, the first abutment shoulder associated with a first exhaust outlet of the plurality of exhaust outlets, the first exhaust outlet coupled to a first cylinder of the four cylinders, the second abutment shoulder associated with a last exhaust outlet of the plurality of exhaust outlets, the last exhaust outlet coupled to a last cylinder of the four cylinders. A second example of the system optionally includes the first example and further includes, wherein each of the at least two abutment shoulders is present in a respective recess along the mating surface of the cylinder head.

It will be appreciated by those skilled in the art that although the invention has been described by way of example, with reference to one or more examples, it is not limited to the disclosed examples and alternative examples may be constructed without departing from the scope of the invention as defined by the appended claims.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cylinder head for an internal combustion engine, comprising:

a plurality of exhaust outlets distributed along a longitudinal axis of the cylinder head, each exhaust outlet of the plurality of exhaust outlets configured to align with a corresponding exhaust gas transfer tube of an exhaust manifold, each exhaust outlet of the plurality of exhaust outlets including a mating surface configured to receive flanges on the corresponding exhaust gas transfer tube; and at least two abutment shoulders, each of the at least two abutment shoulders associated with a different exhaust outlet of the plurality of exhaust outlets and extending beyond a respective mating surface, the at least two abutment shoulders integral with a remainder of the cylinder head, each of the at least two abutment shoulders having an abutment surface configured to interface with the corresponding exhaust gas transfer tube to restrict a lengthwise contraction of the exhaust manifold, wherein the at least two abutment shoulders are spaced to form respective first gaps between each abutment surface of each of the at least two abutment shoulders and a corresponding exhaust gas transfer tube when the exhaust manifold and the cylinder head are first assembled.

2. The cylinder head of claim 1, wherein each of the at least two abutment shoulders are provided at an edge of the respective mating surface.

3. The cylinder head of claim 2, wherein each edge of each respective mating surface flanks a respective recess of that mating surface.

4. The cylinder head of claim 1, wherein the at least two abutment shoulders are each provided between respective neighboring exhaust outlets of the plurality of exhaust outlets.

5. The cylinder head of claim 1, wherein the at least two abutment shoulders are each provided on a side of the respective mating surface that faces away from a respective end of the cylinder head.

6. The cylinder of claim 1, wherein a first abutment shoulder of the at least two abutment shoulders is associated with a first exhaust outlet of the plurality of exhaust outlets at a first end of the cylinder head and a second abutment shoulder of the at least two abutment shoulders is associated with a second exhaust outlet of the at least two abutment shoulders at a second end of the cylinder head.

7. The cylinder head of claim 1, wherein each exhaust outlet of the plurality of exhaust outlets has one or fewer abutment shoulders of the at least two abutment shoulders associated therewith.

8. The cylinder head of claim 7, wherein each of the at least two abutment shoulders includes a further surface opposite the respective abutment surface, each further surface arranged to face a corresponding neighboring exhaust gas transfer tube.

9. The cylinder head of claim 8, wherein each of the at least two abutment shoulders is spaced to form respective second gaps between the further surface of each of the at least two abutment shoulders and the neighboring exhaust gas transfer tube when the exhaust manifold and the cylinder head are first assembled and during expansion of the exhaust manifold the at least two abutment shoulders permit expansion of the exhaust manifold.

10. The cylinder head of claim 8, wherein each further surface of each of the at least two abutment shoulders is ramped.

11. The cylinder head of claim 1, wherein at least one of the at least two abutment shoulders is configured to support a heat shield of the internal combustion engine.

12. A cylinder head, comprising;

an exhaust manifold mating surface;

a first abutment shoulder extending beyond the mating surface into a first interstice of a common exhaust manifold that separates adjacent exhaust gas transfer tubes of the common exhaust manifold and including a first abutment surface; and a second abutment shoulder extending beyond the mating surface into a second interstice of the common exhaust manifold that separates adjacent exhaust gas transfer tubes of the common exhaust manifold, and including a second abutment surface, the first and second abutment shoulders integral with a remainder of the cylinder head, each of the first and second abutment surfaces configured to interface with a respective adjoining wall of the common exhaust manifold, wherein the first abutment shoulder includes a first ramped surface opposite the first abutment surface, and the second abutment shoulder includes a second ramped surface opposite the second abutment surface, such that each of the first abutment shoulder and the second abutment shoulder narrow toward a respective end of each abutment shoulder farthest from the mating surface.

13. The cylinder head of claim 12, wherein the first abutment surface and the second abutment surface are each substantially perpendicular relative to the mating surface, the first and second abutment shoulders and surfaces shaped and positioned to restrict contraction of the common exhaust manifold.

14. The cylinder head of claim 12, further comprising a first gap between the first abutment surface and a first facing wall of the common exhaust manifold and a second gap, larger than the first gap, between the first ramped abutment surface and a second facing wall of the common exhaust manifold.

15. The cylinder head of claim 14, further comprising a third gap between the second abutment surface and a third facing wall of the common exhaust manifold and a fourth gap, larger than the third gap, between the second ramped abutment surface and a fourth facing wall of the common exhaust manifold.

16. A cylinder head for an internal combustion engine, comprising:

a plurality of exhaust outlets distributed along a longitudinal axis of the cylinder head, the plurality of exhaust outlets configured to align with corresponding exhaust gas transfer tubes of an exhaust manifold, each exhaust outlet of the plurality of exhaust outlets configured to receive a corresponding flange on a corresponding exhaust gas transfer tube; and at least two abutment shoulders, each of the at least two abutment shoulders associated with a different exhaust outlet of the plurality of exhaust outlets and extending beyond a mating surface of the cylinder head, the at least two abutment shoulders integral with a remainder of the cylinder head, each of the at least two abutment shoulders having a respective abutment surface configured to interface with a corresponding exhaust gas transfer tube to restrict a lengthwise contraction of the exhaust manifold, each abutment surface substantially perpendicular to the mating surface, and each of the at least two abutment shoulders having a respective ramped abutment surface such that each of the at least two abutment shoulders narrow toward a respective end of each abutment shoulder farthest from the mating surface of the cylinder head, wherein each respective ramped abutment surface is opposite the respective abutment surface of that abutment shoulder, and non-perpendicular to the mating surface.

17. The cylinder head for the internal combustion engine of claim 16, wherein each of the at least two abutment shoulders is present in a respective recess along the mating surface of the cylinder head.

18. The cylinder head for the internal combustion engine of claim 16, wherein the cylinder head defines four cylinders of the internal combustion engine, each cylinder of the four cylinders coupled to a corresponding exhaust outlet of the plurality of exhaust outlets, the at least two abutment shoulders including only a first abutment shoulder and a second abutment shoulder, the first abutment shoulder associated with a first exhaust outlet of the plurality of exhaust outlets, the first exhaust outlet coupled to a first cylinder of the four cylinders, the second abutment shoulder associated with a last exhaust outlet of the plurality of exhaust outlets, the last exhaust outlet coupled to a last cylinder of the four cylinders.

* * * * *